US008925133B2

(12) United States Patent
Lee et al.

(10) Patent No.: US 8,925,133 B2
(45) Date of Patent: Jan. 6, 2015

(54) PORTABLE FLOOR SWEEPER

(75) Inventors: Wai Cheong Lee, Hong Kong (CN); Raymon Wai Man Wong, Hong Kong (CN); Kwok Fung Pang, Hong Kong (CN)

(73) Assignee: Kwonnie Electrical Products Limited, Hong Kong (CN)

( * ) Notice: Subject to any disclaimer, the term of this patent is extended or adjusted under 35 U.S.C. 154(b) by 201 days.

(21) Appl. No.: 13/502,449

(22) PCT Filed: Dec. 3, 2010

(86) PCT No.: PCT/CN2010/001951
§ 371 (c)(1),
(2), (4) Date: Apr. 17, 2012

(87) PCT Pub. No.: WO2011/066720
PCT Pub. Date: Jun. 9, 2011

(65) Prior Publication Data

US 2012/0233792 A1 Sep. 20, 2012

Related U.S. Application Data

(60) Provisional application No. 61/266,550, filed on Dec. 4, 2009.

(51) Int. Cl.

| | |
|---|---|
| ***A47L 11/24*** | (2006.01) |
| ***A47L 11/33*** | (2006.01) |
| ***A47L 11/40*** | (2006.01) |

(52) U.S. Cl.
CPC ..... *A47L 11/33* (2013.01); *A47L 11/4041* (2013.01); *A47L 11/4044* (2013.01); *A47L 11/4058* (2013.01); *A47L 11/4069* (2013.01)
USPC ..... 15/42; 15/41.1

(58) Field of Classification Search
USPC ..... 15/42, 41.1, 52.1, 49.1
See application file for complete search history.

(56) References Cited

U.S. PATENT DOCUMENTS

| | | | | |
|---|---|---|---|---|
| 3,879,788 | A * | 4/1975 | Cousin | 15/42 |
| 5,208,935 | A * | 5/1993 | Jailor et al. | 15/41.1 |
| 7,152,267 | B2 | 12/2006 | Kaleta | |
| 7,591,039 | B2 * | 9/2009 | Kaleta et al. | 15/42 |
| 2008/0172820 | A1 | 7/2008 | Yoo | |

FOREIGN PATENT DOCUMENTS

| | | | |
|---|---|---|---|
| CN | 1833594 | A | 9/2006 |
| CN | 101669803 | A | 3/2010 |
| CN | 201537056 | U | 8/2010 |
| EP | 0 315 068 | A2 | 5/1989 |

OTHER PUBLICATIONS

State Intellectual Property Office of the People's Republic of China, International Search Report in International Patent Application No. PCT/CN2010/001951.

* cited by examiner

*Primary Examiner* — Shay Karls
(74) *Attorney, Agent, or Firm* — Leydig, Voit & Mayer, Ltd.

(57) ABSTRACT

A floor sweeper that picks up large particles without compromising the ability to collect dust. First and second rotary brush parts received in respective concavities in a base of the sweeper, have mouths disposed at different heights.

12 Claims, 9 Drawing Sheets

PORTABLE FLOOR SWEEPER

TECHNICAL FIELD

The present invention relates to a floor sweeper including rotary brushes for sweeping matter into an on-board container.

BACKGROUND OF THE INVENTION

Various different configurations of rotary brush sweepers are known in the art, and these lightweight devices are a low cost alternative to vacuum cleaners. Such sweepers typically include a housing, one or more power-driven rotary brushes that brush the carpet or other floor surface in order to lift dust, dirt particles, and other soiling material from the floor, and rollers, or glide elements that roll or glide along the floor so as to support the sweeper.

U.S. Pat. No. 7,152,267 describes a portable floor sweeper having motorised rotary brushes mounted around all four sides of the sweeper head. Together with an elongate handle mounted by a universal joint this allows the sweeper to provide cleaning action in any direction in which it is moved. The sweeper performs satisfactorily for picking up dust, dirt and like small particles, however the very low profile sweeper head means that performance for sweeping up larger pieces is compromised. It is an object of the present invention to overcome or substantially ameliorate the above disadvantages or more generally to provide an improved handheld floor sweeper.

DISCLOSURE OF THE INVENTION

According to one aspect of the present invention there is provided a portable floor sweeper, comprising:

a body having a periphery, a base and a top;

a container for receiving debris;

first and second brush parts, each brush part comprising at least a portion of one or more elongate rotary brushes mounted to the body;

drive means to rotate the brush parts;

first and second concavities in the base adjacent the periphery of the body, each concavity holding a respective one of the first and second brush parts the sweeper defining a floor-simulating plane which simulates a planar floor supporting the sweeper in use, a mouth of each concavity having a height measured perpendicular to the floor-simulating plane, each brush part having a periphery engaging or spaced apart from the floor-simulating plane such that debris entering through each mouth and engaged by one of the brush parts is propelled into the container, and wherein the heights of the mouths of the concavities vary relative to one another such that matter too large to enter the mouth of one concavity may enter the mouth of the other concavity.

The concavities may be adjacent, or non-adjacent, contiguous, or non-contiguous. The brush parts may rotate about the same axis or different axes. The periphery of each brush part may have a constant diameter, or a variable diameter. One brush may include two brush parts of different diameters, for instance.

Preferably the sweeper further comprises an elongate handle for moving the body across a floor, the periphery of the body is substantially polygonal, each of the brushes having a linear axis. Preferably the axes are arranged substantially orthogonal to one another. Alternatively, the periphery of the body may, for instance, be circular, with each brush having an arcuate form complementary to the circular periphery.

Preferably the first and second brush parts comprise, respectively, first and second elongate rotary brushes, the body is substantially rectangular with a pair of short sides and a pair of long sides, and the first and second concavities lie adjacent one of the long sides and one of the short sides respectively and the sweeper further comprises:

third and fourth concavities in the base adjacent the other of the of the long sides and the short sides respectively;

third and fourth elongate rotary brushes received in the third and fourth concavities respectively;

a mouth of each concavity having a height measured perpendicular to the floor-simulating plane, such that debris entering through each mouth and engaged by a respective one of the brushes is propelled by the respective one of the brushes into the container.

Preferably the heights of the mouths of the first and third concavities are substantially the same, and the heights of the mouths of the second and fourth concavities are substantially the same.

Preferably each mouth has an edge substantially parallel to the floor-simulating plane.

Optionally the height of the mouth of the second concavity exceeds that of the first concavity, the first brush part engages the floor-simulating plane and the second brush part is spaced from the floor-simulating plane.

Optionally the first and second brush parts comprise, respectively, first and second elongate rotary brushes, the sweeper further includes a concavity wall bounding the second concavity and moveably mounted to the body, such that the concavity wall defines the mouth of the second cavity whereby movement of the concavity wall varies the height of the mouth of the second concavity relative to the height of the mouth of the first concavity.

Preferably the concavity wall is moveable relative to the body to maintain the edge of the mouth parallel with the floor-simulating plane, for instance by sliding or pivoting.

Preferably the second rotary brush is fixed to move with the concavity wall.

Preferably the body defines a passage extending between the mouth and the container, the passage includes a narrow throat and the concavity wall is moveable relative to the body to simultaneously increase the height of the mouth and the size of the throat.

Optionally the sweeper further includes a floor-engaging support moveably mounted to the body for supporting the sweeper for movement around the floor, the support having a portion intersecting the floor-simulating plane whereby movement of the support varies the height of the mouth of the second concavity relative to the height of the mouth of the first concavity.

In another aspect the invention provides a portable floor sweeper, comprising:

a body having a periphery, a base and a top;

a container for receiving debris;

an elongate rotary brush mounted to the body;

drive means to rotate the rotary brush;

a concavity in the base adjacent the periphery of the body holding the first brush such that the brush engages a floor-simulating plane which simulates a planar floor supporting the sweeper in use, a mouth of the concavity having a height measured perpendicular to the floor-simulating plane, such that debris entering through the mouth is propelled by the brush into the container;

support means for engaging the floor-simulating plane to support the sweeper upon a floor, and wherein the concavity is moveably mounted such that the height of the mouth of the concavity may be varied.

The support means may comprise, for instance, one or more glide elements, castor wheels, rollers etc. Preferably the elongate rotary brush is mounted to the concavity to move with the concavity relative to the body.

Optionally the portable floor sweeper further comprises a pivot connecting the concavity to the body whereby the concavity is moveably mounted such that the height of the mouth of the concavity may be varied. The portable floor sweeper may further comprise a first mechanism including a pedal manually actuable to rotate the concavity about the pivot. A debris passage extending between the mouth of the concavity and the dirt container includes a throat, and the concavity is configured such that raising the concavity to its raised position increases the dimension of the throat.

Optionally the portable floor sweeper further comprises a second mechanism connecting the support means on at least one side of the body, and actuable for extending and retracting the support means relative to the body, and by which the concavity and attached body are mounted to move together such that the height of the mouth of the concavity may be varied. Preferably the second mechanism includes a pedal and operates with a toggle action.

The first and second mechanisms may directly connect a respective pedal to the concavity or support means respectively, such that pressing and releasing the pedal directly raises and lowers the concavity. Alternatively, the first and second mechanisms may operate with a toggle action, whereby one push on the pedal extends the concavity or support means and latches it in the extended position, while a subsequent push unlatches and lowers the concavity or support means. In other embodiments (not shown) the mechanisms may be operated by a button on the handle, instead of by a pedal. The mechanisms may be entirely mechanical, or it may include powered actuators such as rotary or linear motors. The button may be connected by a conductor or a wireless connection to a controller for operating the powered actuators.

This invention provides a sweeper which is effective and efficient in operational use, and which allows the user to readily sweep material of a range of sizes, from small particles to larger pieces, while still providing a device that may be economically constructed.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
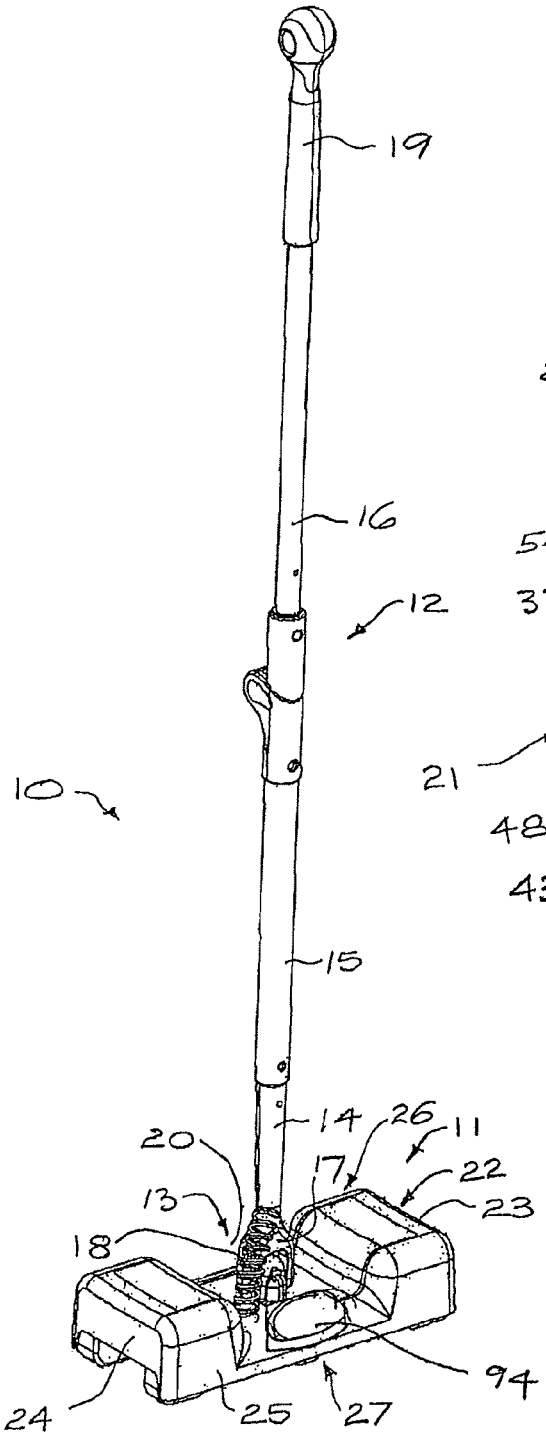
FIG. 1 is a perspective view from above of a first embodiment of a sweeper of the invention.
Figure 2:
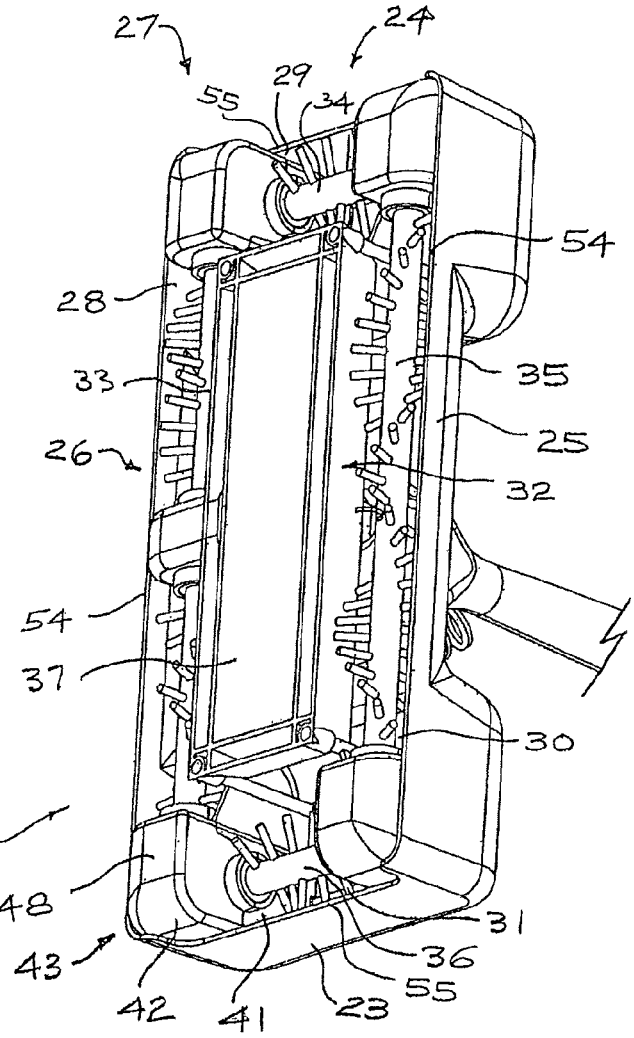
FIG. 2 is a perspective view from below of the sweeper head of the sweeper of FIG. 1.
Figure 3:
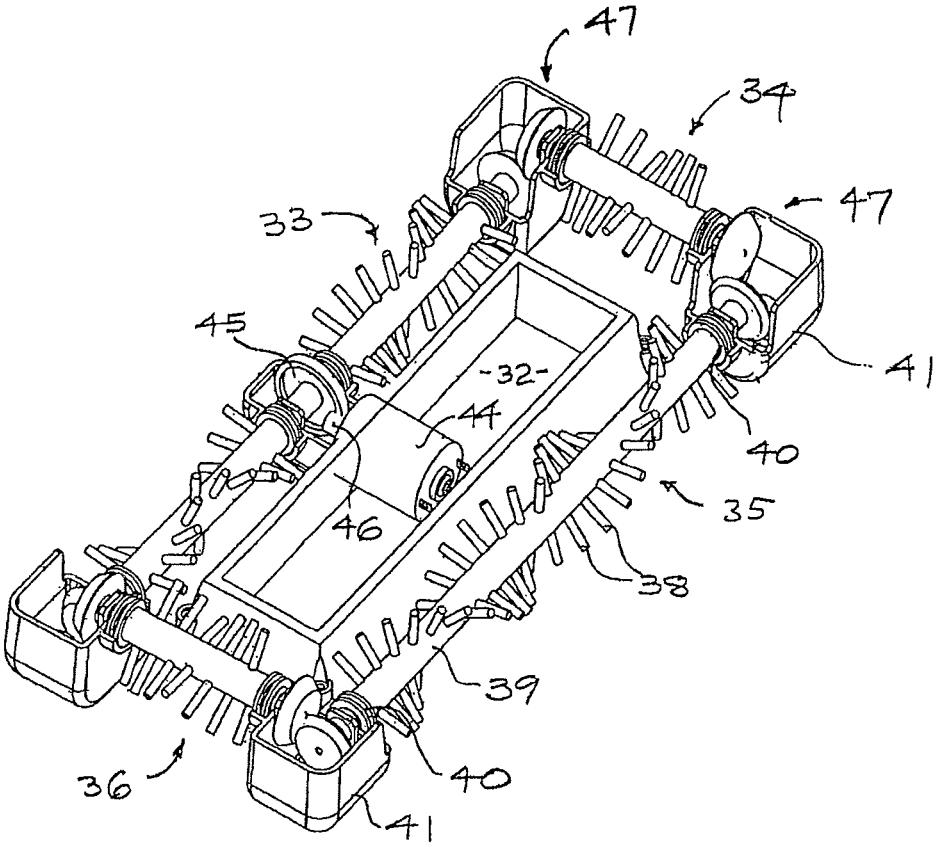
FIG. 3 is a perspective view from above of the principal operating components of the sweeper head of FIG. 1.

Referring to FIGS. 1 and 2, a first embodiment of a sweeper 10 of the present invention includes a sweeper head 11 connected to an elongate handle 12 by a universal joint 13. The handle 12 is assembled from three elongate generally tubular sections 14-16 releasably connected end to end. The innermost tubular section 14 bifurcates at its end to from a yoke 17 of the universal joint 13. The intermediate tubular section 15 serves to hold a battery pack, receiving a plurality of battery cells stacked therein. The batteries provide power to the sweeper head 11 via a conductor 155 which may be coiled. At an end of the outermost tubular section 16 is a grip 19 which is grasped by the user to move the sweeper 10 over a floor. Alternatively, an external battery pack (not shown) may be releasably mounted to the handle 12 for supplying power to the sweeper head 11. Furthermore, it will be understood that the sweeper 10 may be powered from an external source, as by an electrical cord (not shown) connected to a mains power supply. The universal joint 13 includes two mutually perpendicular pivots, although other types of universal pivot connections can be utilized as will be apparent to those skilled in the art of mechanical pivot connections. It is important that the handle 12 freely rotates about the point of connection between the sweeper head 11 and the handle 12.

The sweeper head 11 may have a generally rectangular form, with a central recess in its upper side in which the universal joint 13 is located. The head 11 has a body 21 comprised of a top 22, and a periphery including opposing short sides 23 and 24 and long sides 25 and 26. Opposite the top 22 is a bottom 27.

Formed in the body 21 so as to open in the bottom 27 are four concavities 28-31, each adjacent a respective one of the sides 23-26, and each receiving a rotary brush 33-36. The brushes 33-36 are arranged adjacent the sides of a generally rectangular dirt container 32 having a closure 37. The closure 37 is connected to the body to pivot about an axis along its long edge. A push-button 94 unlatches the closure 37 allowing it to swing outwardly to empty the dirt container 32. The closure is latched in the closed position (shown in the drawings) and the latching mechanism connected to the push-button 94 is not shown.

Each of the brushes 33-36 includes a plurality of soft, flexible fingers 38 formed of an elastomeric material, and protruding from a shaft 39. Alternatively, some or all of the fingers 38 may be in the form of tufts of individual elongate fibres or bristles. The fingers 38 contact the floor surface to be cleaned and sweep the debris up into the container 32. The fingers 38 may protrude radially, and may be spaced as shown in a helical pattern along each brush. The diameter of each brush, defined by the tips of the fingers 38, is the same in the embodiment shown, but brushes with different diameters may also be used. Opposite ends of each shaft 39 are mounted to the sweeper head 11 for rotation by means of journals 40 supported by mounts 43 disposed in the corners of the body 21, each mount 43 comprising inner and outer parts 41, 42. A rotary electric motor 44 disposed in the dirt container 32 is provided for rotating the brushes 33-36 and is operatively connected to the brush 33 by a right-angle gear drive including pinion 46 and wheel 45. A gear train 47 (described in detail with reference to FIG. 9) is disposed in each corner of the sweeper head, by which adjacent brushes are meshed with one another, thereby torque is transmitted via brush 33 to the brushes 34 and 36, which in turn transmit torque to the brush 35. In an alternative embodiment (not shown) pulleys or toothed wheels may be fixed to the ends of the brushes, and a plain or toothed belt or a chain used to transmit torque between adjacent brushes.

Four coplanar glide elements 48 on the mounts 42 have a soft or smooth surface and serve to support the sweeper head 11, allowing it to easily slide over the floor in any direction. Optionally, the glide elements 48 may comprise textile pads, polymer blocks or like known glide elements.

Figure 4:
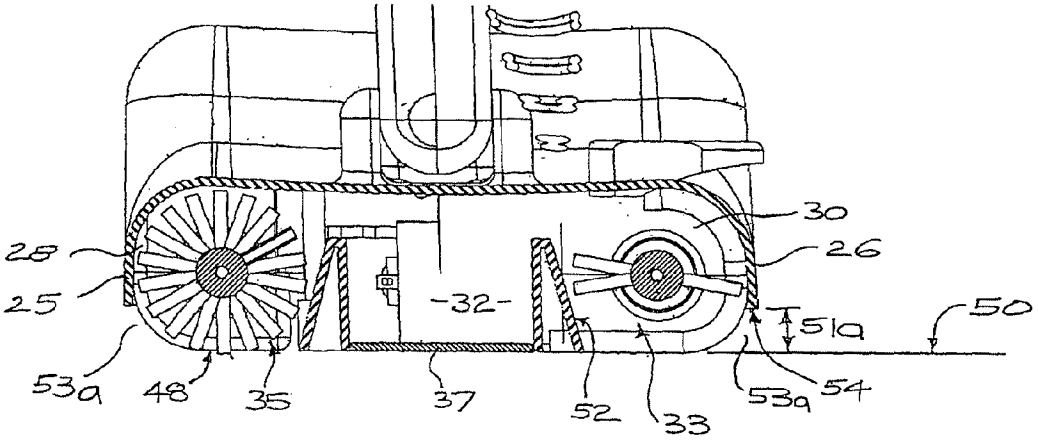
FIG. 4 is a transverse section through a sweeper head of the sweeper of FIG. 1.

Referring to FIG. 4, the concavities 28 and 30 adjacent the long sides 25 and 26 and their respective long brushes 35 and 33 are shown in cross section, with reference to a floor-simulating plane 50 upon which the glide elements 48 rest in use such that both of the brushes 35, 33 engage the plane 50. A mouth 53*a* of each concavity 28, 30 has a height 51*a* measured perpendicular to the floor-simulating plane 50 and defined by an edge 54 of the body 21. Debris entering through each mouth 53*a* may be propelled by one of the brushes up the inclined face 52 into the container 32. The axes of the long brushes 35, 33 are coplanar, as are the edges 54 bounding the long concavities 28, 30.

Figure 5:
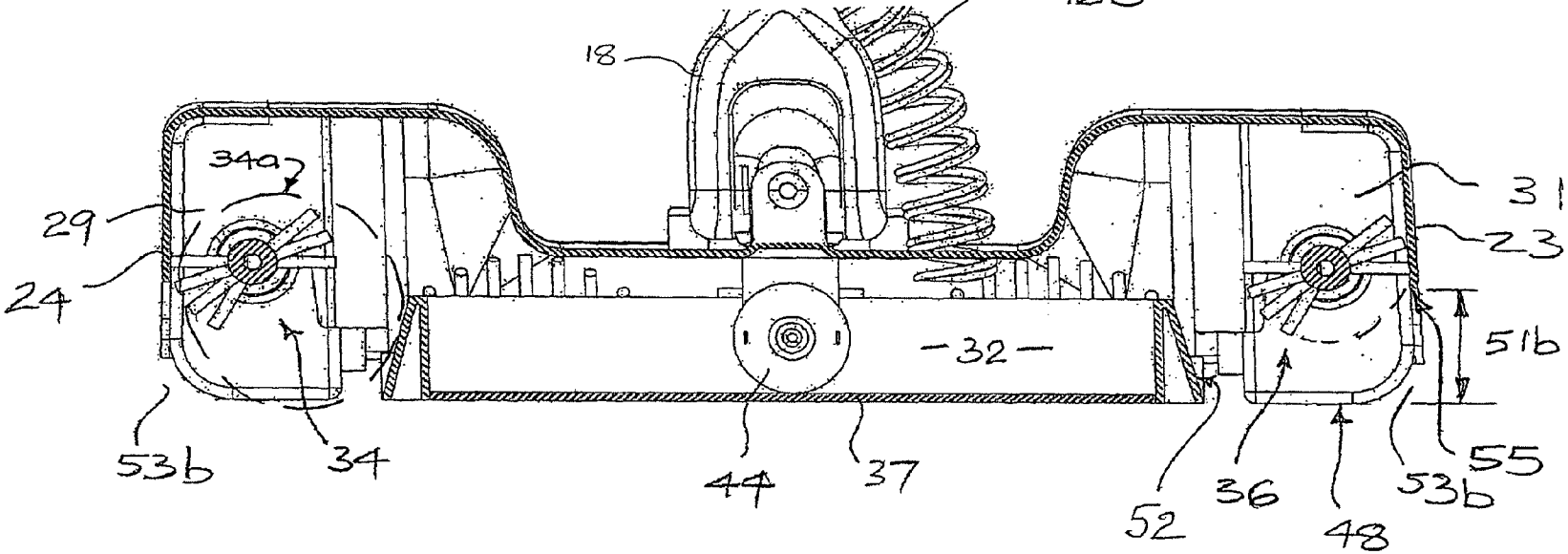
FIG. 5 is a longitudinal section through a sweeper head of the sweeper of FIG. 1.

Correspondingly, FIG. 5 shows the concavities 29 and 31 adjacent the short sides 24 and 23 and their respective short brushes 34 and 36 with reference to the floor-simulating plane 50. A mouth 53*b* of each concavity 29, 31 has a height 51*b* measured perpendicular to the floor-simulating plane 50 and defined by an edge 55 of the body 21. The axes of the short brushes 34, 36 are coplanar, as are the edges 55 bounding the short concavities 29, 31.

In this first embodiment of the invention the height 51*b* of both mouths 53*b* exceeds the height 51*a* of both mouths 53*a*. To allow larger debris to pass, the short brushes 34, 36 are spaced apart from the plane 50, as well as being further apart from the inclined face 52 than is the case with the long brushes 33, 35. However, it will be understood that the short brushes 34, 36 need not be spaced apart from the plane 50, and from the inclined face 52 and that the small diameter brushes 34, 36 shown could be replaced by larger diameter brushes, as indicated by the dashed outline 34*a*. In use, the sweeper 10 may be moved generally parallel to its long axis and if some matter is found to be too large to enter the mouths 51*a*, the tool may be turned to enter the matter through one of the mouths 51*b*.

Figure 6A:
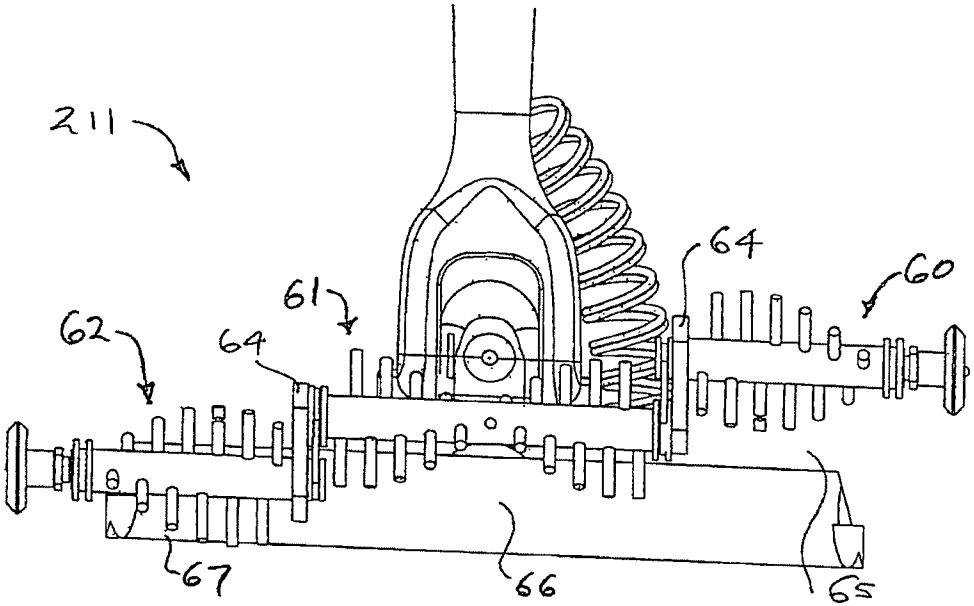
FIGS. 6*a* and 6*b* are fragmentary side and end views respectively of a second embodiment of a sweeper head of the invention.
Figure 6B:
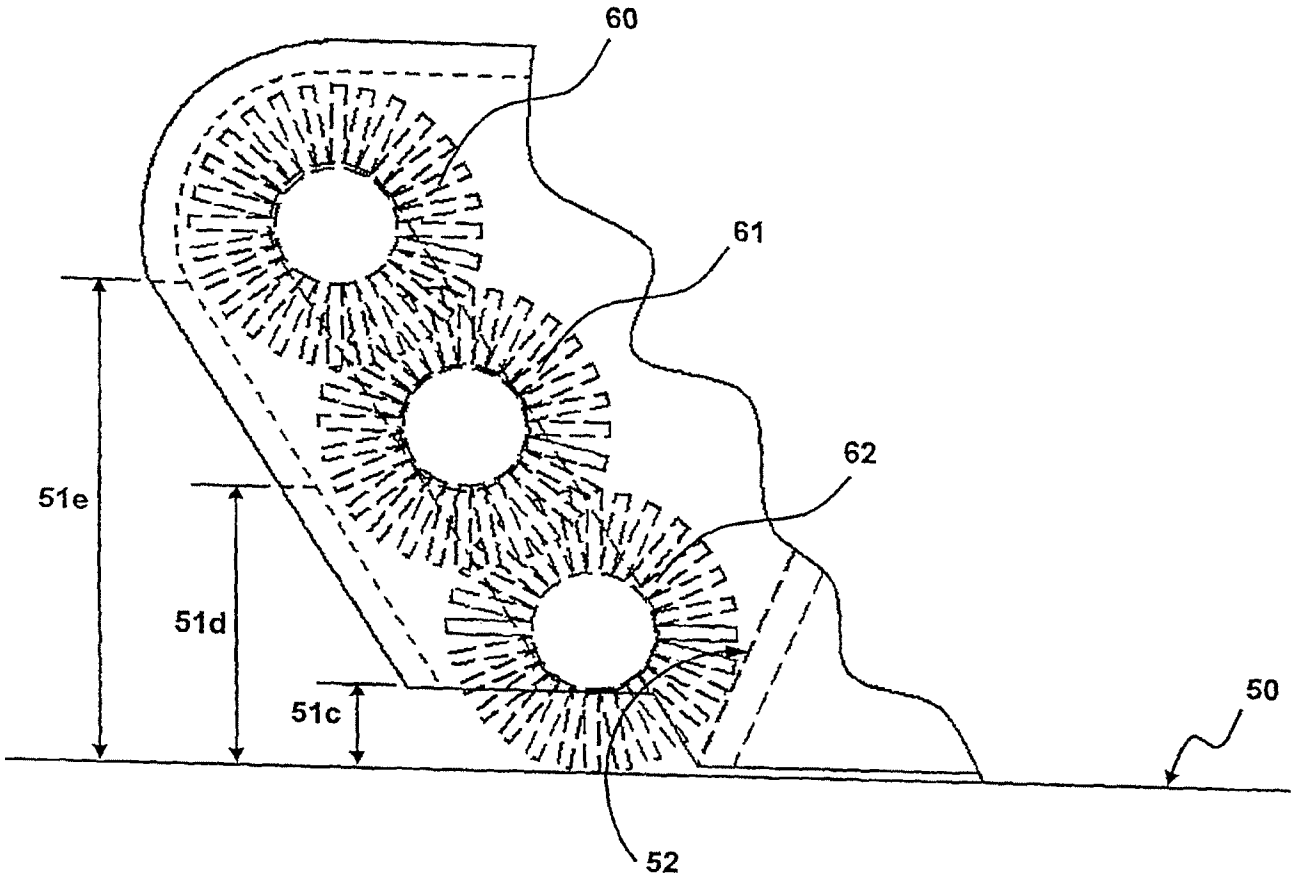

In a second embodiment of the sweeper head 211, shown in FIGS. 6*a* and 6*b*, three motor-driven brushes 60, 61, 62 are received in respective concavities 65, 66, 67 spaced end-to-end along the long side of a sweeper head, for instance to replace a single brush 33, 35 of the first embodiment. However in other respects the sweeper head 211, but may otherwise have like construction to the sweeper head 11 of the first embodiment. The brushes 60-62 are elongate and fixed to the sweeper head 211 to rotate about respective parallel axes. Opposing ends of the central brush 61 are connected, as by belt drives 64 to the inner ends of the outer brushes 60 and 62 such that all are rotated simultaneously. The brush 62 engages the plane 50, while brushes 60 and 61 are spaced apart from the plane 50, with brush 60 uppermost. The edges of the mouths of the concavities 65, 66, 67 are parallel to the axes of the brushes, and at respective heights 51*e*, 51*d* and 51*c*, such that matter found to be too large to enter the mouths of concavities 67 and 66, may enter the mouth of concavity 65.

Figure 7A:
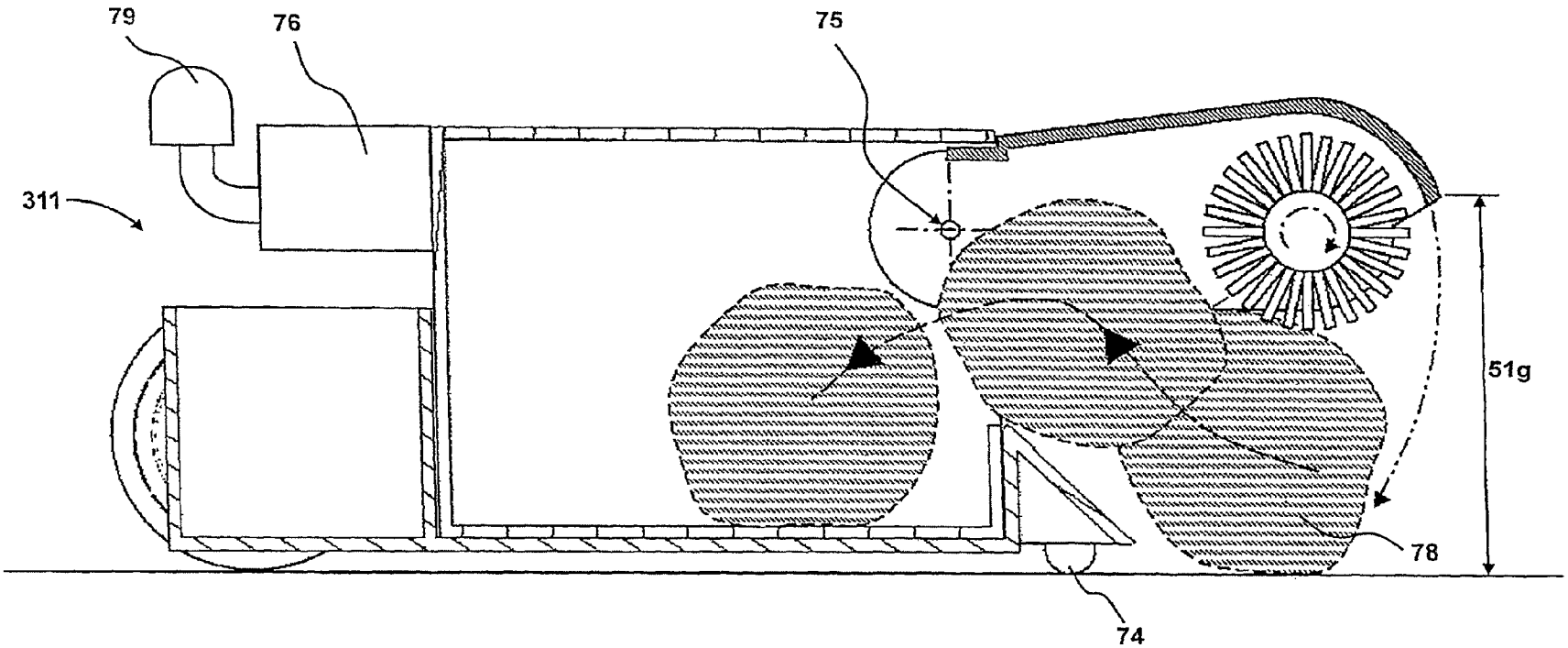
FIGS. 7*a* and 7*b* are schematic sections through a third embodiment of a sweeper head of the invention, showing two operating positions.
Figure 7B:
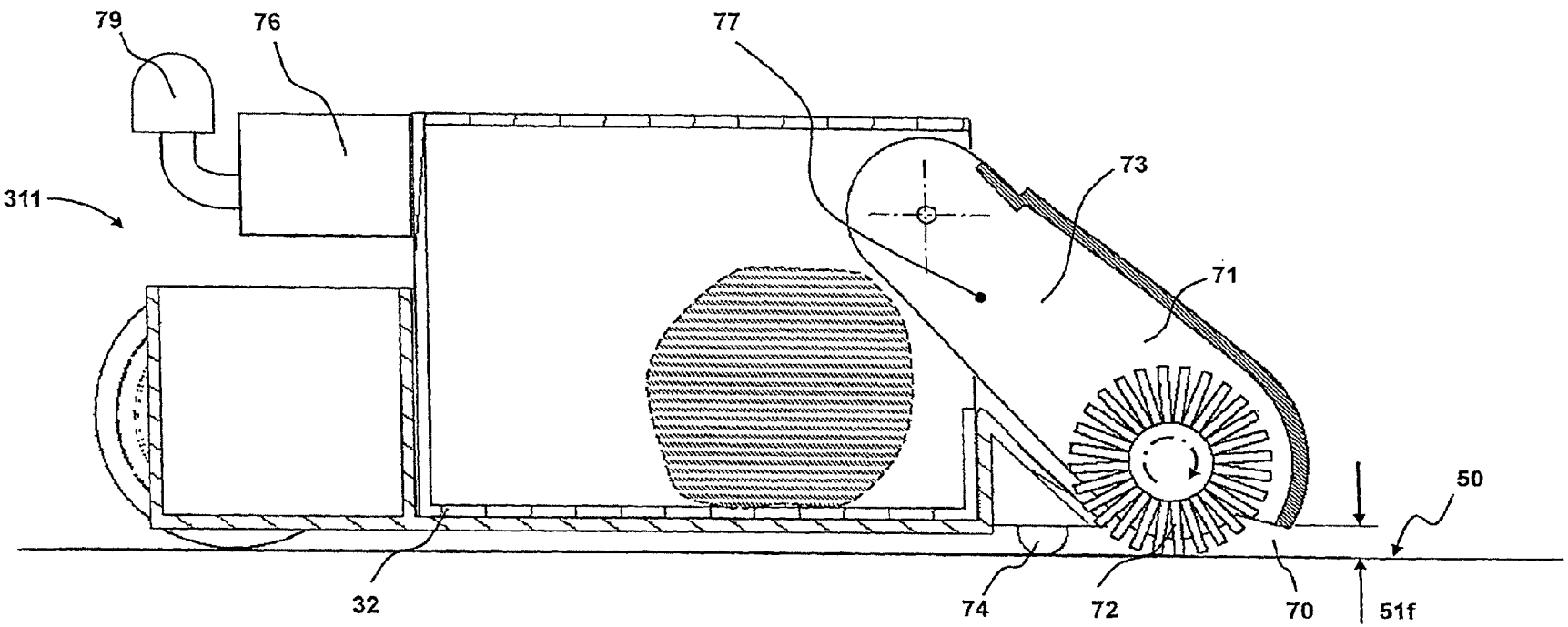

A third embodiment of the invention is illustrated in FIGS. 7*a* and 7*b*, in which the height of the mouth 70 of a concavity 71 may be varied between heights 51*f* and 51*g*, preferably together with a corresponding variation in the spacing of the brush 72 from the plane 50. The concavity 71 holding the brush 72 is formed in a housing section 73 connected to the body of the sweeper head 311 by a pivot 75 and to which the opposing ends of the brush 72 are mounted in journals (not shown). A belt drive (not shown) may provide torque to the brush 72 via a pulley coaxial with the pivot 75. A pedal 79 connected to a cavity-extending mechanism 76 is operatively connected to the housing section 73 for moving it from its lowered position (shown in FIG. 7*b*) to its raised position (shown in FIG. 7*a*). The debris passage extending between the mouth 70 and the dirt container 32 includes a throat 77, and is configured such that raising the housing section 73 to its raised position increases the dimension of the throat 77. The sweeper head 311 may be supported on the plane 50 upon one or more wheels, such as castors 78. The sweeper head 311 is rectangular and the housing section 73 is provided along one side, while the other three sides may be constructed substantially like construction to the sweeper head 11 of the first embodiment. In use, the user actuates the mechanism 76 to raise the housing section 73 to sweep up pieces 78 too large to be picked up otherwise, before moving the sweeper head 311 to enter the pieces 78 into the mouth 70, whereupon the mechanism 76 may be released. The housing section 73 may drop, assisting in pushing the pieces 78 into the container 32.

Figure 8:
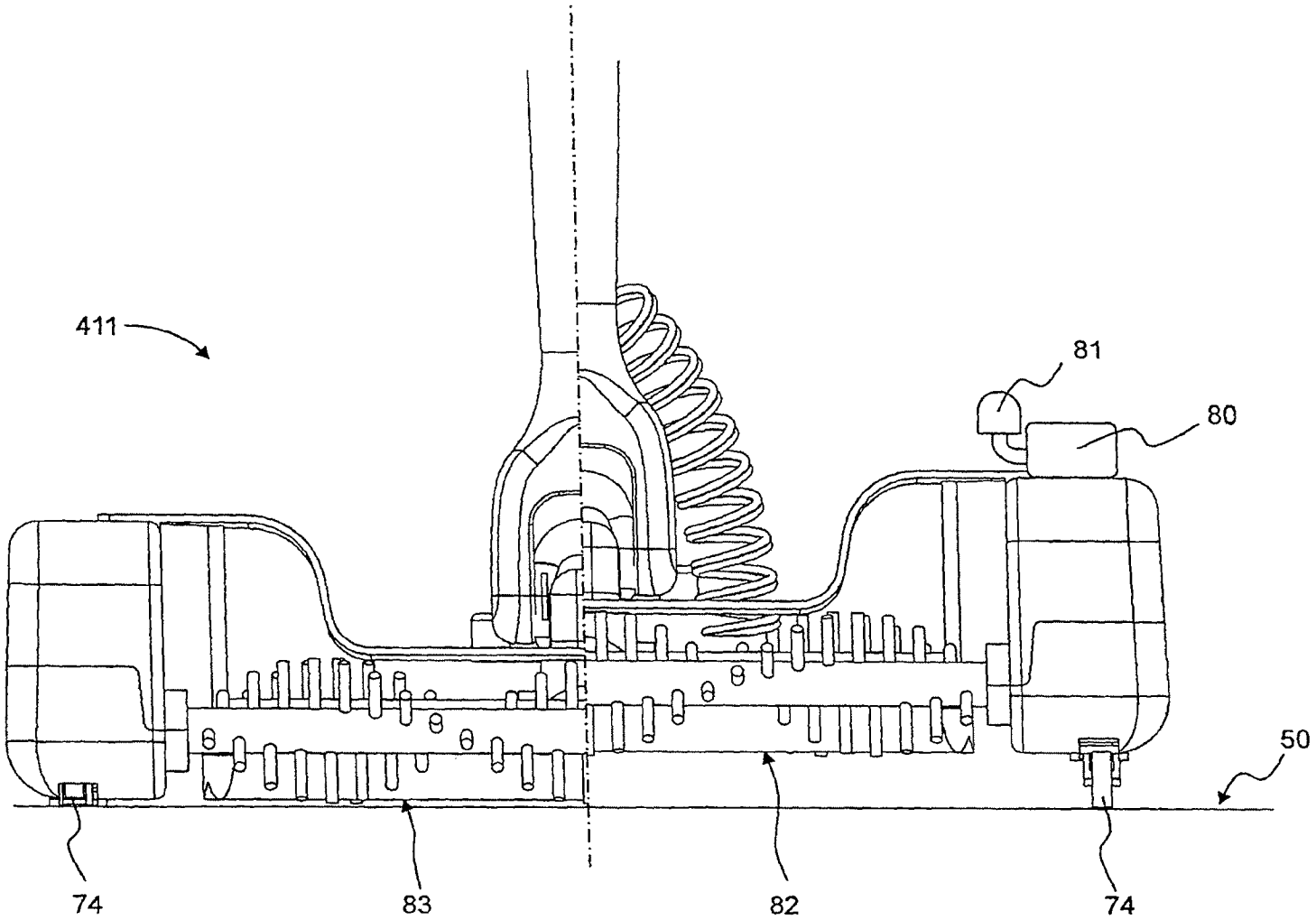
FIG. 8 is a longitudinal section through a fourth embodiment of a sweeper head of the invention, showing two operating positions.

Referring to FIG. 8, in a fourth embodiment of the invention has generally like construction to the sweeper head 11 of the first embodiment, however in place of at least one of the glide elements, the sweeper head 411 is supported upon one or more wheels, such as castor 74. A wheel-extending mechanism 80 is operatively connected to the castor 74 and is actuable by pedal 81 to move the castor 74 between the extended and retracted positions shown. The mechanism 80 may operate with a toggle action, whereby one push on the pedal 81 extends the castor 74 to raise at least one side of the sweeper head 411 and latches it in the extended position, while a subsequent push unlatches the castor 74, lowering the sweeper head 411. The wheel-extending mechanism 80 may raise the whole sweeper substantially without rotation, or alternatively it may rotate the sweeper to raise only one side.

Figure 9:
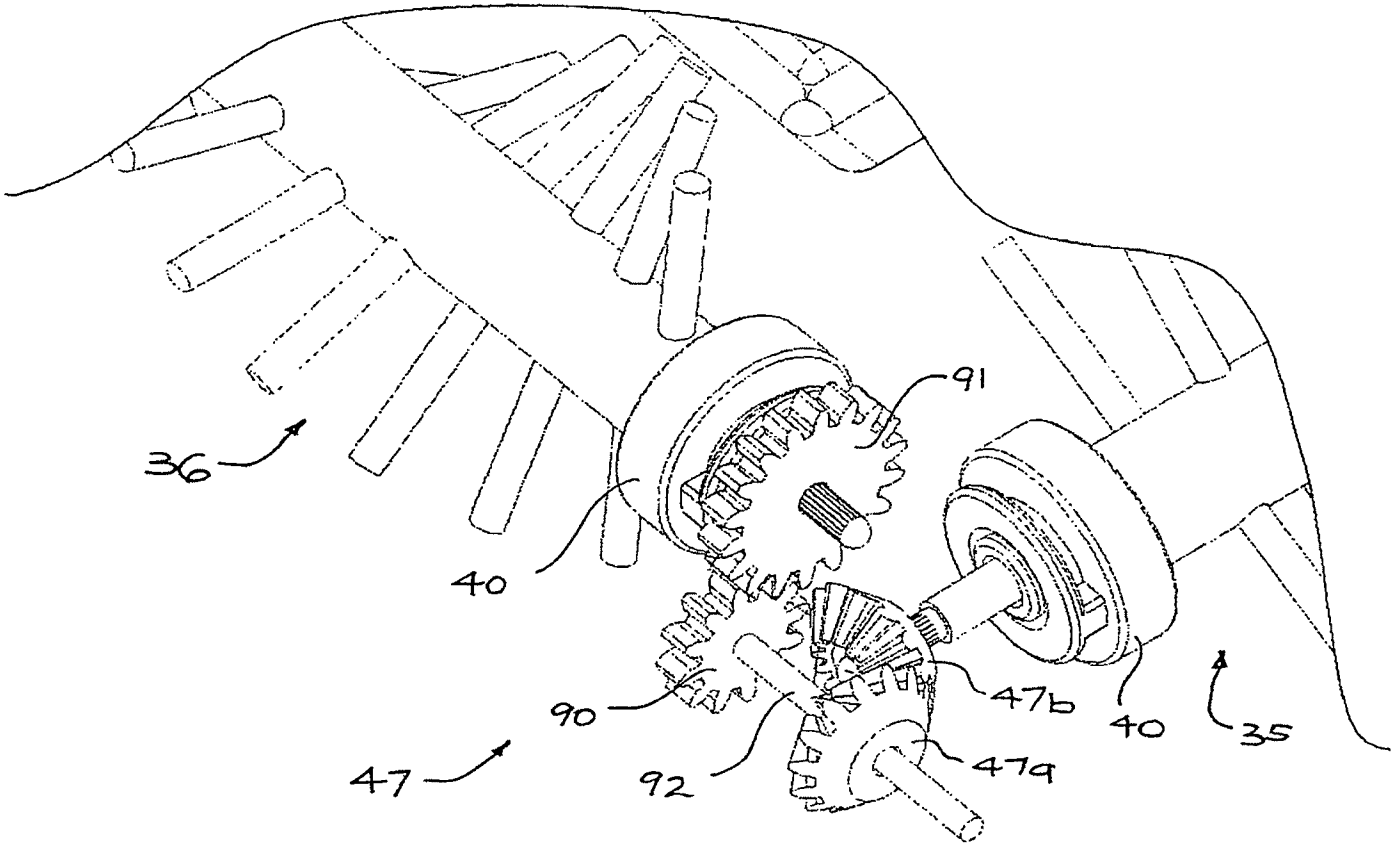
FIG. 9 is a fragmentary detail of an alternative transmission for transmitting torque between two brushes of a sweeper head of the invention.

FIG. 9 illustrates a transmission for transmitting torque between two brushes 35, 36 of a sweeper head which are perpendicular to one another, and having non-intersecting axes disposed in parallel planes. To accommodate the offset a spur gear pair 90, 91 transmits torque to the bevel gear pair 47*a*, 47*b*. The gear 91 is mounted coaxial and rotationally fast with the brush 36 and meshes with the gear 90 supported to rotate on a shaft 92 parallel to the brush 36, with the spur gear 90 and bevel gear 47*a* being fixed to rotate together with the shaft 92.

Aspects of the present invention have been described by way of example only and it should be appreciated that modifications and additions may be made thereto without departing from the scope thereof.

The invention claimed is:

1. A floor sweeper comprising:

a body having a periphery, a base, and a top;

a container for receiving debris;

first and second elongate rotary brushes mounted on the body;

a support mounted on the body and supporting the floor sweeper on a planar floor being cleaned by the floor sweeper, as the floor sweeper moves across the planar floor;

drive means for rotating the first and second brushes;

a torque transmitting device transmitting torque from the first brush to the second brush; and first and second concavities in the base, adjacent the periphery of the body, wherein the body holds, in each of the first and second concavities, a respective one of the first and second brushes, each of the first and second concavities has a mouth having a height, measured perpendicular to the planar floor, each of the first and second brushes has a periphery engaging or spaced apart from the planar floor such that debris entering through each mouth and engaged by one of the first and second brushes is propelled into the container, and the height of the mouth of the first concavity is smaller than the height of the mouth of the second concavity such that debris too large to enter the mouth of the first concavity may enter the mouth of the second concavity.

2. The floor sweeper of claim 1 further comprising an elongate handle for moving the body across the planar floor, wherein the periphery of the body is substantially polygonal, and each of the first and second brushes has a linear axis.

3. The floor sweeper of claim 2 wherein the linear axes are substantially orthogonal to each other.

4. The floor sweeper of claim 2 wherein, when the first brush engages the planar floor, the second brush is spaced from the planar floor.

5. The floor sweeper of claim 4 wherein the linear axes of the first and second brushes are substantially parallel to each other, and the torque transmitting device comprises an endless belt.

6. The floor sweeper of claim 4 wherein the linear axes of the first and second brushes are substantially perpendicular to each other, and the torque transmitting device comprises a gear train including a pair of bevel gears engaging a pair of spur gears.

7. The floor sweeper of claim 2 wherein the drive means comprises an electric motor disposed in the container.

8. The floor sweeper of claim 7 wherein the linear axes of the first and second brushes are substantially perpendicular to each other, the torque transmitting device comprises a gear train including a pair of bevel gears engaging a pair of spur gears, and the floor sweeper further comprises an innermost, intermediate tubular section and an outermost elongate tubular section, wherein the innermost, intermediate tubular section and the outmost elongate tubular section are releasably connectable, end-to-end, to form an elongate handle, and a universal joint connecting the handle to the body, wherein the innermost, tubular section is bifurcated at one end as a yoke of the universal joint, and the innermost, intermediate tubular section receives a plurality of battery cells for providing electrical power to the electric motor via a coiled conductor that passes between the handle and the body.

9. The floor sweeper of claim 1 wherein the body is substantially rectangular and includes a pair of relatively shorter sides and a pair of relatively longer sides, the first and second concavities lie adjacent a first of the longer sides and a first of the shorter sides, respectively, and the floor sweeper further comprises third and fourth concavities in the base adjacent a second of the longer sides and a second of the shorter sides, respectively, and third and fourth elongate rotary brushes located in the third and fourth concavities, respectively, wherein each of the third and fourth concavities has a mouth having a height, measured perpendicular to the planar floor, such that debris entering through each mouth of the third and fourth concavities and engaged by a respective one of the third and fourth brushes is propelled by the respective brush into the container.

10. The floor sweeper of claim 9 wherein the heights of the mouths of the first and third concavities are substantially the same, and the heights of the mouths of the second and fourth concavities are substantially the same.

11. The floor sweeper of claim 10 wherein, when the first and third brushes engage the planar floor, the second and fourth brushes are spaced from the planar floor.

12. The floor sweeper of claim 1 wherein each mouth has an edge substantially parallel to the plane.

* * * * *